United States Patent [19]

Rybak

[11] 4,414,522

[45] Nov. 8, 1983

[54] FABRICATED LIFTING MAGNET ASSEMBLY

[75] Inventor: James P. Rybak, Solon, Ohio

[73] Assignee: Magnetics International, Inc., Maple Heights, Ohio

[21] Appl. No.: 374,496

[22] Filed: May 3, 1982

[51] Int. Cl.[3] ..... H01F 7/20

[52] U.S. Cl. ..... 335/291; 335/294; 294/65.5

[58] Field of Search ..... 335/289, 290, 291, 292, 335/294; 294/65.5

[56] References Cited

U.S. PATENT DOCUMENTS 3,693,126 9/1972 Rybak ..... 294/65.5
3,763,453 10/1973 Schurr ..... 335/292
3,984,796 10/1976 Frampton ..... 335/294 X

FOREIGN PATENT DOCUMENTS 52-44592 8/1977 Japan ..... 294/65.5

*Primary Examiner*—George Harris
*Attorney, Agent, or Firm*—Pearne, Gordon, Sessions, McCoy, Granger & Tilberry

[57] ABSTRACT

A lifting magnet assembly is disclosed which has a permeable magnetic case with a central core and an outer peripheral wall. Electrical winding means surrounds the coil and is inside the outer wall. A composite magnetically permeable case top is provided in the magnet assembly, the composite case top including a cast steel member and a uniform thickness top plate welded together. The composite case top is welded to the core and to the outer peripheral wall, and the cast steel member is generally in the form of a spider with a plurality of arms extending from a central annular portion. This cast steel member performs the triple function of stiffening the steel top plate, providing the connector means to the lifting chain, and providing a flux path supplemental to the top plate for the magnet flux. A single size of cast steel member may be used for a plurality of sizes of magnet assemblies. A central pole piece is secured to the outer end of the core, and transverse forces on the edge of the central pole piece are transmitted to the core by a steel cylinder recessed into apertures in both the core and the pole piece. The foregoing abstract is merely a resume of one general application, is not a complete discussion of all principles of operation or applications, and is not to be construed as a limitation on the scope of the claimed subject matter.

25 Claims, 7 Drawing Figures

FABRICATED LIFTING MAGNET ASSEMBLY

BACKGROUND OF THE INVENTION

Lifting magnets have been used for decades for lifting magnetically permeable material without the need for physical attachment to the object, for example, by cables or chains. Steel slabs are moved in this manner, and also scrap iron is moved, for example, from a railroad car to a pile of scrap to be used in a melting furnace in a steel mill. Such lifting magnets typically have had a central pole piece surrounded by a coil and an outer peripheral pole piece within a magnet assembly, generally of a flat disc shape, supported by chains on a lifting crane. Such lifting magnets had a large annular air gap between the central pole piece and the peripheral pole piece, and this air gap is designed to be bridged by the object or objects to be lifted. Where such object is a flat object, such as a steel slab, a good surface-to-surface contact may be made between the lifting magnet pole pieces and the steel slab object, and therefore the magnet assembly may lift considerably more weight than if the object is scrap iron. Scrap iron, made of pipe or other objects of irregular shape, will not have a good area of contact at the pole pieces, but generally only a line contact. This prevents such lifting magnet from lifting as much weight of scrap iron as that of steel slabs.

The magnet case for lifting magnets has traditionally been made from a cast material, such as cast steel, as shown in U.S. Pat. Nos. 928,510 and 1,015,728. This cast steel upper portion of the magnet case provides protection to the winding, provides a tapering flux path tapering to a thinner cross section at the radially outer edges, and provides a strong structure which will withstand battering of the magnet by the lifting magnet crane operator during use.

It was long ago realized that it was wasteful of cast steel material and crane lifting energy to have a constant thickness top plate on the magnet case because the greatest flux density in such top plate was adjacent the central core. It was realized one could keep generally uniform flux density throughout the radial dimension of the magnet case top plate by making this top casting gradually tapering to a smaller thickness at the outer periphery. This tapering shape was generally shown in U.S. Pat. Nos. 1,334,504, 1,459,830 and 4,112,248.

Lifting magnets fabricated from steel plate have also been suggested, for example, as in U.S. Pat. No. 3,984,796. Such lifting magnet assembly had a steel plate, for example, of cold-rolled steel, which had uniform thickness and was utilized for the top plate of the magnet case. This was inefficient in the weight versus lifting capacity because the uniform thickness top plate would have a high flux density near the central core and a low flux density at the outer periphery. It, therefore, had been previously suggested to utilize a stack of annular, uniform-thickness plates welded together, successive plates becoming smaller in outer diameter to thus achieve a fabricated top plate which had greater thickness near the central core and lesser thickness at the outer periphery.

The fabricated magnets of a plurality of steel plates were one solution to the problem of obtaining good castings of steel to be used for the magnet case on the lifting magnets. Typically, such steel castings are relatively complex and, due to their large size, a part of the sand mold or core might break loose during pouring of the molten steel, thus making a defective steel casting.

Also, lifting magnets were desired in a wide range of lifting capacities, e.g., from 300 pounds to 17,000 pounds, which took a very large number of diameters of lifting magnets to achieve this lifting capacity range. Each one took a different size casting, which increased the manufacturing cost.

SUMMARY OF THE INVENTION

The problem to be solved, therefore, is how to construct a lifting magnet which will have the requisite strength to withstand the usual battering to which the magnet is subjected and a tapered thickness case top to the magnet case for generally uniform flux density, thus having a minimum weight of the magnet assembly for the lifting capacity, yet eliminating the need for a different large, expensive steel casting for each different diameter lifting magnet.

This problem is solved by a fabricated lifting magnet assembly comprising, in combination, a permeable magnetic case having a permeable magnetic core, electrical winding means surrounding said core, outer wall means in said case at the periphery thereof, support means underneath said winding means to support said winding means within said magnetic case, and a composite, magnetically permeable case top connected in flux passing relationship with said outer wall means and said core, said composite case top including a magnetically permeable cast member and magnetically permeable supplemental means of substantially uniform thickness, means securing said cast member to said supplemental means for flux flow in each, connector means for the dependent support of said lifting magnet assembly connected as an integral part of said cast member near the outer edges thereof, and said cast member at locations near said core being of considerably greater thickness than at the outer edges thereof.

Another problem in lifting magnet assemblies is how to adequately secure the central pole piece not only so that the pole piece is in tight flux transmitting engagement with the core but also so that this pole piece can withstand transverse blows or other transverse forces. Such forces are often most severe when the magnet is swung in an arc by the lifting crane and the central pole piece is that which strikes a fixed object rather than the peripheral pole piece striking the object. Usually in the past, long bolts have extended through the core parallel to the axis to secure together the core and the pole piece, but such bolts are expensive and tend to loosen with repeated vibration and shock.

The problem is further solved by a lifting magnet assembly comprising, in combination, a permeable magnetic case having a permeable magnetic core, electrical winding means surrounding said core, outer wall means in said case at the periphery thereof, support means underneath said winding means to support said winding means within said magnetic case, a magnetically permeable case top connected in flux passing relationship with said outer wall means and said core, and a replaceable central pole shoe on the outer end of said core, said central pole shoe having an aperture, said outer end of said core having an aperture, a transverse force transmitting member closely fitted in said two apertures to transmit transverse force on said central pole shoe to said core, and means to secure said central pole shoe to said core.

Accordingly, an object of the invention is to provide a fabricated lifting magnet with a composite case top of the magnetic case, the case top including a magnetically permeable cast member and a magnetically permeable supplemental means of substantially uniform thickness.

Another object of the invention is to provide a cast member of a given diameter which may be used with a range of sizes of lifting magnet cases and which may be welded to a uniform thickness top plate of variable diameter.

A further object of the invention is to provide a composite case top for a lifting magnet wherein a uniform thickness steel top plate is used, together with a cast member, the cast member providing the triple function of stiffening the top plate, providing the connector means to the lifting chains, and providing supplemental flux carrying capacity to the top plate.

Other ojects and a fuller understanding of the invention may be had by referring to the following description and claims, taken in conjunction with the accompanying drawings.

DESCRIPTION OF THE PREFERRED EMBODIMENTS

Figure 1:
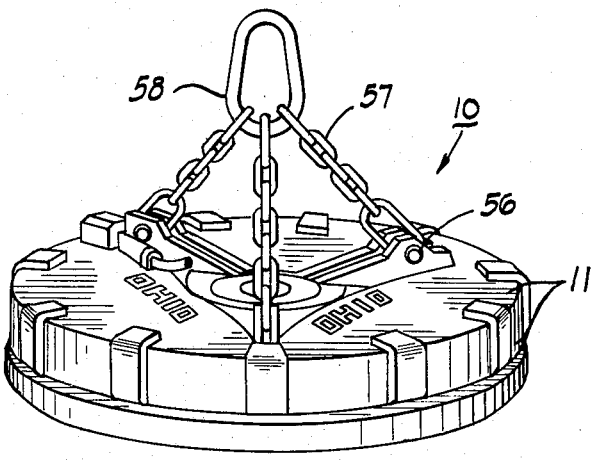
FIG. 1 is a perspective view of the fabricated lifting magnet assembly according to the invention.
Figure 3:
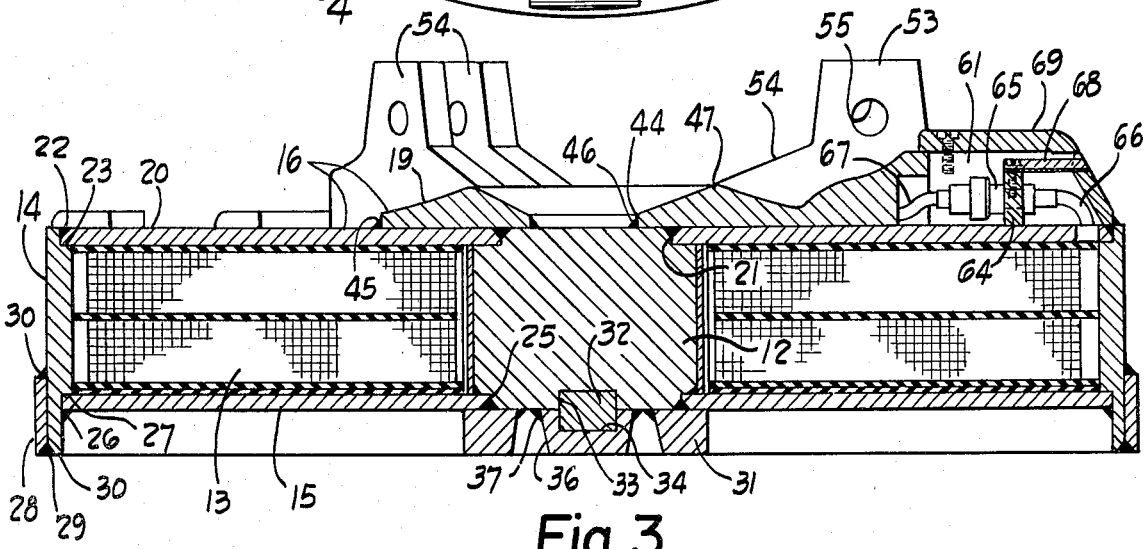
FIG. 3 is a sectional view on the line 3—3 of FIG. 2.

FIG. 1 illustrates a perspective view of a lifting magnet assembly 10 which embodies the invention. This magnet assembly has a permeable magnetic case 11, with a permeable magnetic core 12 as shown in FIG. 3. An electrical coil or winding means 13 surrounds the core 12 and the magnetic case 11 has outer wall means 14 extending around the periphery of this winding means 13. Support means 15 is provided underneath the winding means to support this winding means within the magnetic case 11 and to enclose it for protection. The magnetic case 11 further includes a composite case top 16 to complete the magnetic case and to physically support and protect the electrical winding means 13.

The outer wall means 14 may be formed from separate segments, but preferably is a continuous band of magnetically permeable material, e.g., cold-rolled steel plate welded together to form an annular outer wall 14. The electrical winding means 13 may be a single coil or a plurality of coils connected in any usual manner, depending upon the voltage and current requirements. The composite case top 16 is magnetically permeable and includes a magnetically permeable cast member 19 and magnetically permeable supplemental means 20 of substantially uniform thickness. The cast member 19 may be made of cast iron, for example; however, cast steel is preferred for its greater strength. The supplemental means may most conveniently be made from a flat steel plate, e.g.; cold-rolled steel, which inherently gives the substantially uniform thickness. This supplemental means 20 may be called a top plate, which is disc-shaped and annular. It has a central aperture 21 which is welded to a shoulder at the top of the core 12 so as to be in good flux passing relationship with the core. The outer periphery of the top plate 20 is welded at 22 to an annular shoulder 23 in the outer wall 14. This provides good flux passing relationship between the case top 16 and the outer wall 14. The support means 15 is preferably a support plate of nonmagnetic material, such as aluminum or manganese steel, and this support plate 15 has a central aperture 25 welded to the bottom of the core 12 and the outer periphery welded at 26 to an annular shoulder 27 in the outer wall means 14. An abrasion-resistant outer ring 28 of magnetically permeable material is welded at 29 and 30 to this outer wall 14 to establish a hard and wear-resistant but replaceable, peripheral pole shoe.

A central pole shoe 31 is mounted in good flux passing relationship with the bottom of the core 12 by having complementary flat, machined surfaces. A solid steel cylinder 32 is mounted with a close fit within a cylindrical recess 33 in the bottom of the core 12 and within a cylindrical recess 34 in the uper portion of the central pole shoe 31. Tapered conical apertures 36 are provided through the thickness of the central pole shoe 31 and there may be four such apertures, for example. This permits welding the pole shoe 31 to the bottom of the core 12 by weld metal 37 around the periphery of each aperture at the bottom of the core 12. This eliminates any bolts or screws and eliminates the usual loosening of such threaded fasteners during use, yet makes a replaceable pole shoe when the pole shoe becomes worn during use. The pole shoe 31 is replaceable by cutting away the weld metal 37. The steel cylinder 32 is a close fit in both apertures 33 and 34 and absorbs the majority of the force of lateral blows on the side of the pole piece 31, for example, as the crane drops the lifting magnet assembly 10 into a pile of scrap metal. The pole shoe 31 may have the lower surface thereof recessed above the level of the peripheral pole shoe 30, or, as shown, it may be in the same plane. Reinforcing angular plates 38 engage the case top 16 and the outer wall 14, and are welded thereto at generally symmetrical positions around the periphery in order to reinforce and strengthen the entire magnet assembly.

Figure 4:
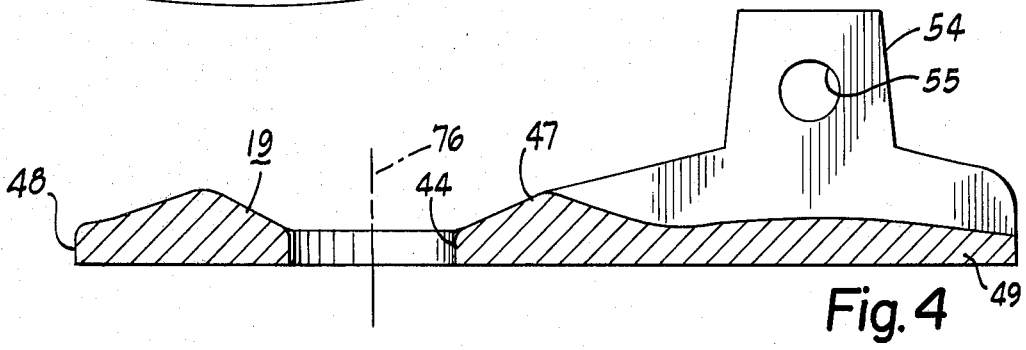
FIG. 4 is an enlarged sectional view on the line 4—4 of FIG. 2.
Figure 5:
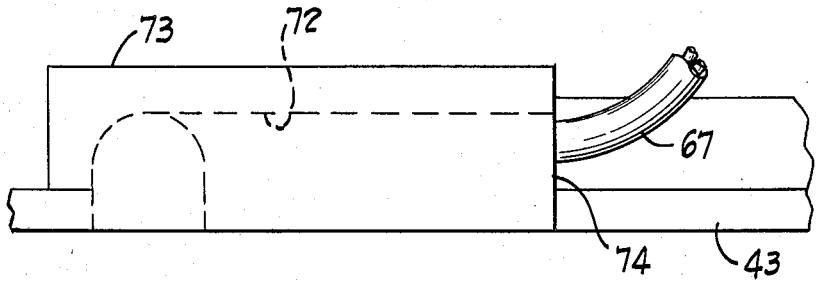
FIG. 5 is an enlarged sectional view on the line 5—5 of FIG. 2.

The composite case top 16 includes the cast member 19 and the top plate 20. The cast member 19 may be considered a spider because it has a plurality of extending arms 40, 41, and 42, and also this cast member has a central annulus portion 43 of a given radius r to the outer periphery 48 of this central circular portion. The lower surface of this cast member 19 is preferably machined to a flat surface for good surface-to-surface contact with the top plate 20. Weld metal 45 is then utilized around the entire periphery of the cast spider member 19 in order to weld this cast member to the top plate 20. Also, weld metal 46 welds the cast member 19 to the top of the magnetic core 12 at the central aperture 44. This welding 45 and 46 provides a good flux transfer from the core 12 to the cast member 19 and to the top plate 20, and also good flux transfer from the cast member 19 to the top plate 20. The top plate 20 might be one inch thick, for example for a 58-inch diameter magnet, and the cast member 19 might be several times that thick at the thickest part 47 closely adjacent the core 12. The central annulus portion 43 tapers down to a thinner cross-sectional dimension at the periphery 48 of this central annulus portion. This is shown in FIGS. 3 and 4. Also, at the outer ends 49 of the plural arms 40, 41, and 42, the cross-sectional thickness is even less than at the periphery 48 of the central annulus portion 43. The weld metal 45 and 46 is a means to secure together the cast member 19 and supplemental means 20 for flux flow in each of these two members.

Connector means 53 are provided as an integral part of the cast member 19, and these connector means are for the dependent support of the lifting magnet assembly 10. These connector means are shown as being unitary with the outer ends of the arms 40, 41, and 42, and each includes a pair of upstanding, substantially radial lugs 54 which are apertured at 55 to receive a pin 56 to secure the lifting chain 57. Three such chains are secured to a crane ring 58 so that the entire assembly 10 may be lifted and moved by a crane.

An electrical terminal box 61 is connected as an integral part of the case top 16, and in the preferred embodiment, this terminal box 61 is unitary with the end of the arm 42. This terminal box 61 has generally radially extending walls 62 and 63, which are extensions of the radial lugs 54. This terminal box has an intermediate wall 64 through which electrical terminals 65 are insulatedly mounted. Leads 66 from the electrical winding means 13 are secured to one end of such electrical terminals 65 and an external cable 67 has the conductors therein connected to the other end of such terminals 65. A first cover 68 is secured to the terminal box 61 to enclose the internal leads 66. A second cover 69 is secured to the terminal box 61 to make it watertight, to protect personnel from the electrical connections, and yet to provide ready access to such terminals 65.

Figure 6:
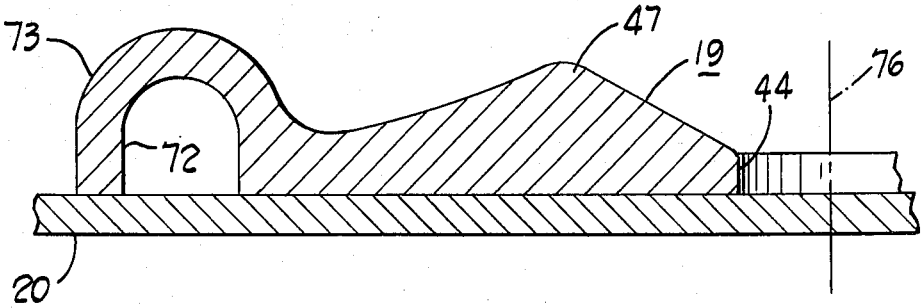
FIG. 6 is an enlarged sectional view on the line 6—6 of FIG. 2.
Figure 2:
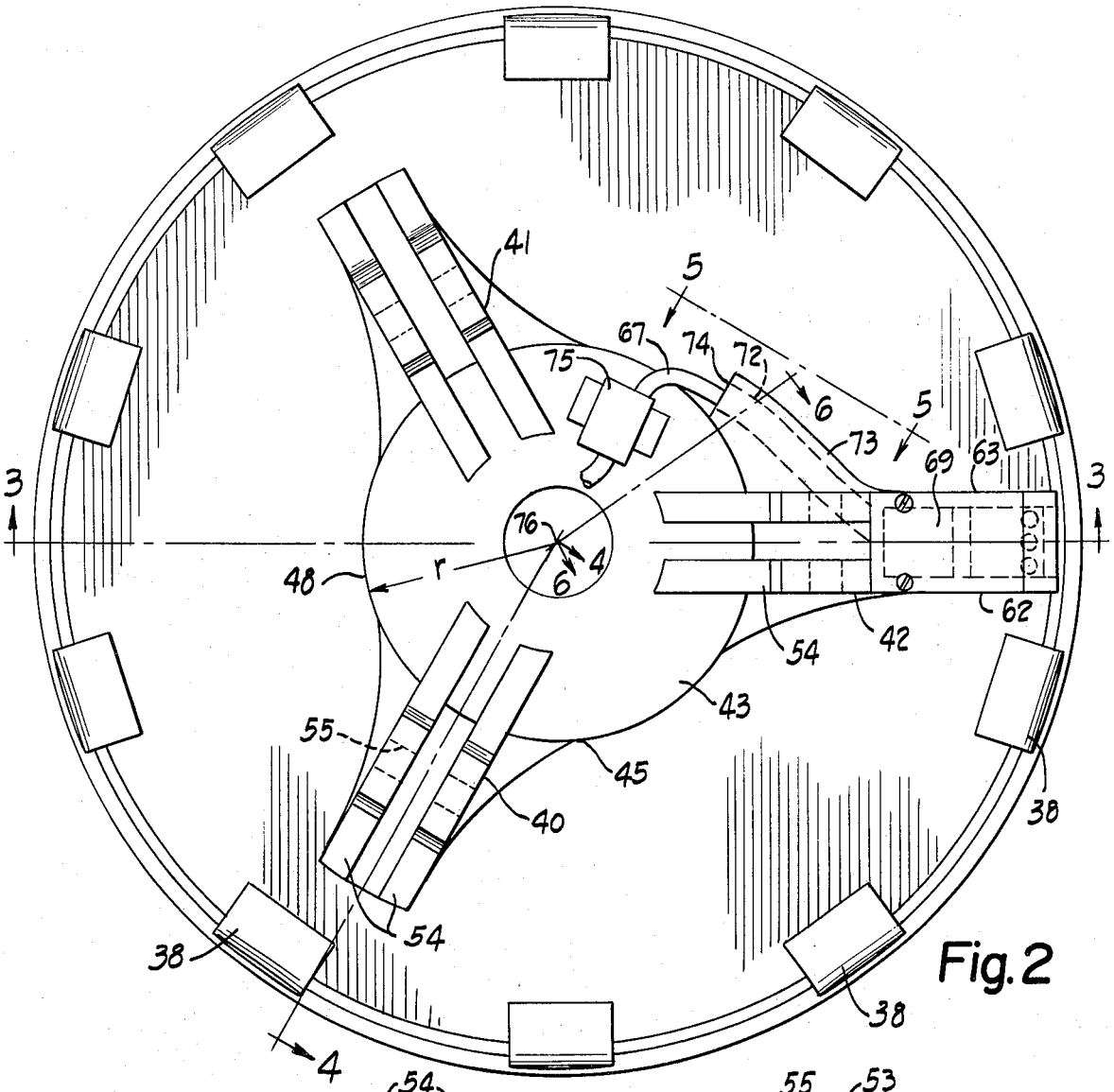
FIG. 2 is an enlarged, top plan view of the magnet assembly, with the chains removed.

A cable passageway 72 is an inverted U-shape, as shown in FIG. 6, and has one open side. This cable passageway is formed as a unitary part of the cast member 19 in a radially extended portion 73. The one open side of this passageway 72 is closed by the top plate 20. The fact that this cable passageway 72 has an inverted U-shape means that the passageway may be cast as a unitary part of the cast member 19, utilizing only a two-part mold, and does not have to be a cored passageway. Also, this provides a strong physical protection for the electrical cable 67. This passageway 72 extends from the terminal box 61 to an entrance opening 74 close to the central annulus portion 43. The external cable 67 within this passageway 72 passes through a cable clamp 75 close to the central axis 76 and then passes upwardly for external electrical connection.

The fabricated lifting magnet assembly 10 provides a composite case top 16, which is partly made from the cast member 19 and partly from the top plate 20. The two are welded together, and the cast member performs three functions of stiffening the top plate 20, providing the connector means 53 for the lifting chains 57, and providing a supplemental flux path for the top plate 20. A fourth function is also achieved in the preferred embodiment, namely, the cast member provides integral therewith the electrical terminal box 61.

Figure 7:
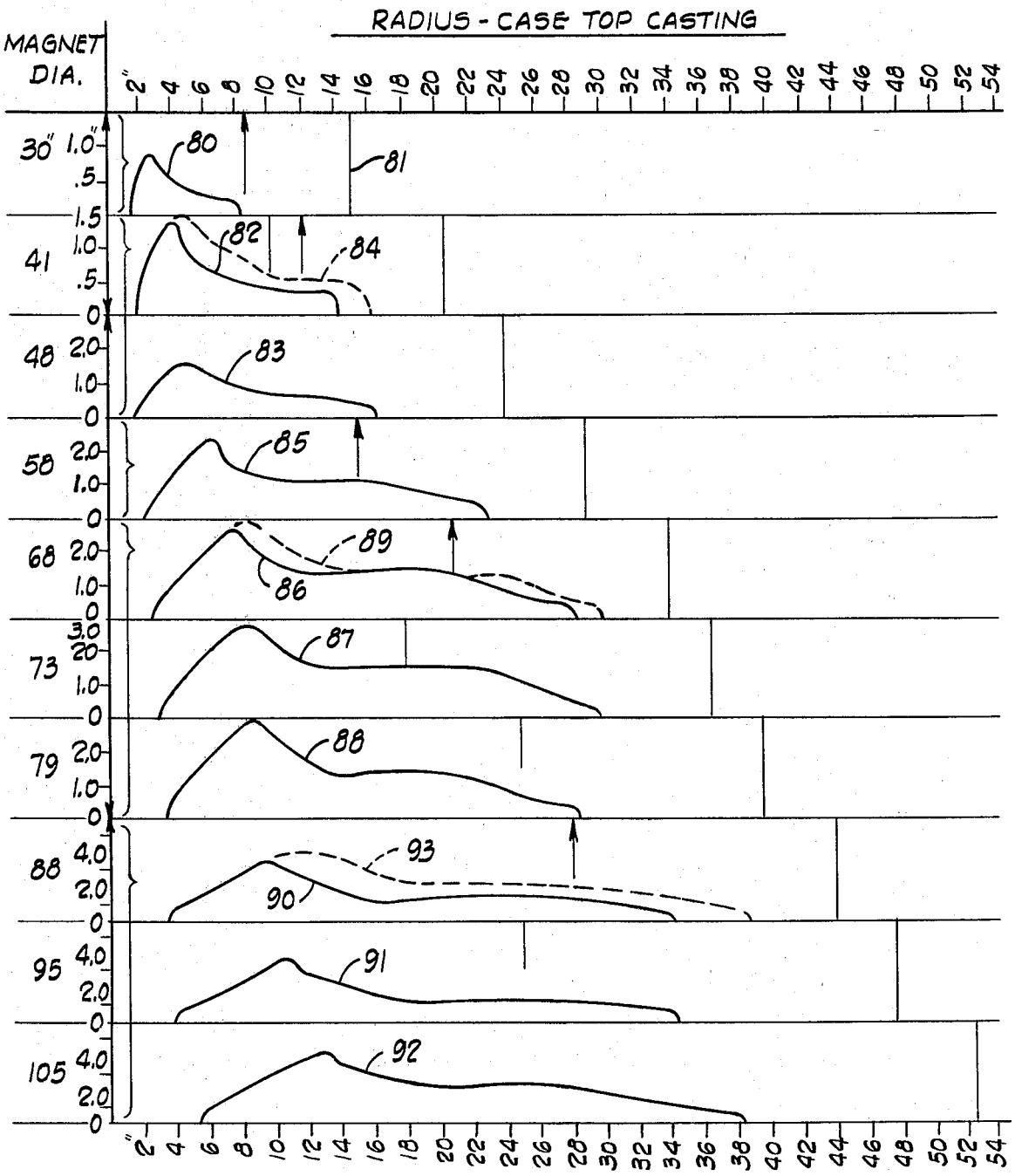
FIG. 7 is a graph of cross-sectional profiles of the range of sizes of case top castings.

FIG. 7 is a graph of a computer-generated profile sheet which, along the left side, identifies the diameter of ten different magnet sizes and also the thickness of casting 19 in inches, and along the abscissa, the radius of casting 19 is shown in inches. This FIG. 7 shows that five different sizes of cast members 19 are used for the ten different diameters of magnet assemblies. The curve 80 shows the radial section profile of the cast member 19 for a 30-inch diameter magnet assembly 10, with the radius of this magnet assembly shown by the bar 81. Curves 82 and 83 show the designed radial cross section profile for the cast member 19 for 41- and 48-inch diameter magnets, respectively. The dotted curve 84 is a composite of the two curves 82 and 83 and is the radial cross section profile of the cast member 19 which would be used with each of these two magnet sizes. Curve 85 shows the radial cross section profile designed for a 58-inch diameter magnet. Curves 86, 87, and 88 show the computer-generated radial cross section profile for 68, 73, and 79-inch diameter magnets, respectively. The dotted curve 89 is a composite profile of all three curves 86, 87, and 88, and is the radial cross section profile of an actual cast member which is utilized with each one of these three different magnet sizes. Curves 90, 91, and 92 are the computer-generated radial cross section profiles of 88, 95, and 105-inch diameter magnet assemblies, respectively. The dotted curve 93 is a composite of the curves 90, 91, and 92, and is the profile of the actual cast member 19 which is utilized with each of these three different sizes of magnet assemblies. It will therefore be seen that only five different cast members 19 are utilized for a full range of sizes of magnet assemblies from 30 inches to 105 inches in diameter. This shows that one cast member 19 may be combined with the supplemental means 20 of different diameters to establish composite case tops 16 in a range of diameters.

The cast member 19 is a much simpler, smaller, and lighter casting than the typical cast case top for a lifting magnet assembly. It has only about one-third to one-eighth the total amount of cast metal therein compared to such prior art cast case tops, which is a considerable saving in complexity and weight of the casting. Furthermore, since the cast member 19 is a much simplified casting and a much smaller diameter, the percentage of good castings coming from the sand molds is greatly increased, with far fewer of the castings being scrapped because of defects therein. The entire magnet assembly is strong and lightweight for its lifting capacity, and yet has good magnetic properties to supply a maximum of flux from the pole tips into the objects being lifted.

From the drawings, it will be evident that the supplemental means 20 is a member of substantially uniform thickness and extends at least from the outer periphery of the cast member 19 to the outer wall 14. In the preferred embodiment, this supplemental means is a top plate which extends completely from the outer periphery of the core 12 to the outer wall 14, and lies between the cast member 19 and the winding means 13.

In the preferred embodiment, it will be noted that the cast member 19 has an outer periphery which is disposed at a radius from the axis 76 which is smaller than the radius of the outer wall of the magnet assembly. This is especially true for the central annulus portion 43, and is still true for the arms 40 and 41, and also the arm 42. This central annulus portion 43 is a toroidal portion having the given radius n, which is substantially less than the radius of the magnet assembly 10.

The lifting magnet assembly also provides the replaceable, central pole shoe 31, which is replaceable by cutting away the weld metal 37. The steel cylinder 32 is a transverse force transmitting member so that if and when the magnet is swung in an arc by the lifting crane and the outer edge of the central pole piece 31 is that which first strikes an object, then this is a severe transverse force on the pole piece 31 and is transmitted to the core 12 by this steel cylinder 32. By this means, such transverse force does not need to be transmitted by the securing means, namely, the weld metal 37. The solid steel cylinder 32, of course, has a circular periphery, and this aids in transmitting the force in all 360 degrees transverse to the axis 76. The fact that the steel cylinder is closely received in the cylindrical apertures in the core and in the pole piece is that which establishes the means to readily transmit the transverse force between the pole piece and the core.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A fabricated lifting magnet assembly comprising, in combination:

a permeable magnetic case having a permeable magnetic core;

electrical winding means surrounding said core;

outer wall means in said case at the periphery thereof;

support means underneath said winding means to support said winding means within said magnetic case; and a composite magnetically permeable case top in said case connected in flux passing relationship with said outer wall means and said core;

said composite case top including a magnetically permeable cast member and magnetically permeable supplemental means of substantially uniform thickness;

means securing said cast member to said supplemental means for flux flow in each, connector means for the dependent support of said lifting magnet assembly connected as an integral part of said cast member near the outer edges thereof, and said cast member at locations near said core being of considerably greater thickness than at the outer edges thereof.

2. A fabricated lifting magnet assembly as set forth in claim 1, wherein said supplemental means is a substantially uniform thickness plate member extending at least from the outer edge of said cast member to said outer wall means.

3. A fabricated lifting magnet assembly as set forth in claim 1, wherein said supplemental means and said cast member extend inwardly at least to the outer periphery of said core.

4. A fabricated lifting magnet assembly as set forth in claim 1, wherein said supplemental means is a top plate substantially continuous between said outer wall means and said core.

5. A fabricated lifting magnet assembly as set forth in claim 1, wherein said supplemental means is disposed between said cast member and said winding means.

6. A fabricated lifting magnet assembly as set forth in claim 1, wherein said outer wall means is a continuous outer wall of rolled steel plate.

7. A fabricated lifting magnet assembly as set forth in claim 1, wherein said supplemental member is an annular rolled steel plate.

8. A fabricated lifting magnet assembly as set forth in claim 1, wherein said securing means is weld means.

9. A fabricated lifting magnet assembly as set forth in claim 1, wherein said connector means are apertured lugs upstanding from said cast member.

10. A fabricated lifting magnet assembly as set forth in claim 1, wherein said one cast member may be combined with supplemental means of different sizes to establish composite case tops in a range of diameters.

11. A fabricated lifting magnet assembly as set forth in claim 1, wherein said cast member is a spider having at least three substantially radially extending arms.

12. A fabricated lifting magnet assembly as set forth in claim 11, wherein said connector means are near the outer ends of said arms.

13. A fabricated lifting magnet assembly as set forth in claim 1, wherein said cast member includes an annulus with a first cross section thickness adjacent said core and a substantially thinner cross section at the outer edge thereof.

14. A fabricated lifting magnet assembly as set forth in claim 13, wherein said outer edge of said annulus is disposed at a radius from the axis of said winding means which is smaller than the radius of said magnet assembly.

15. A fabricated lifting magnet assembly as set forth in claim 1, wherein said supplemental means is a substantially uniform thickness steel plate extending from said core to said outer wall means, said cast member is a cast steel spider with a flat lower surface engaging said plate, and said securing means is weld means securing said spider to said plate.

16. A fabricated lifting magnet assembly as set forth in claim 1, including an electrical terminal box formed as a unitary part of said cast member.

17. A fabricated lifting magnet assembly as set forth in claim 16, including a passageway for external electrical leads to said terminal box having one side thereof exposed to and covered by said supplemental means.

18. A fabricated lifting magnet assembly as set forth in claim 1, wherein said cast member has a central toroidal portion with a given radius which is substantially less than the radius of said magnetic case.

19. A lifting magnet assembly comprising, in combination:

a permeable magnetic case having a permeable magnetic core;

electrical winding means surrounding said core;

outer wall means in said case at the periphery thereof;

support means underneath said winding means to support said winding means within said magnetic case;

a magnetically permeable case top in said case connected in flux passing relationship with said outer wall means and said core; and a replaceable central pole shoe on the outer end of said core;

said central pole shoe having an aperture, said outer end of said core having an aperture, a transverse force transmitting member closely fitted in said two apertures to transmit transverse force on said central pole shoe to said core, and means to secure said central pole shoe to said core.

20. A lifting magnet assembly as set forth in claim 19, wherein said aperture in said pole piece extends only part way into said pole piece to be not visible from the outer surface of said pole piece.

21. A lifting magnet assembly as set forth in claim 19, wherein said force transmitting member is circular in cross section.

22. A lifting magnet assembly as set forth in claim 19, wherein said apertures are circular in cross section and each of substantially the same diameter.

23. A lifting magnet assembly as set forth in claim 19, wherein said force transmitting member is cylindrical.

24. A lifting magnet assembly as set forth in claim 19, wherein said securing means is weld metal.

25. A fabricated lifting magnetic assembly as set forth in claim 1, wherein said connector means are connected as a unitary part of said cast member near the outer edges thereof.

* * * * *